US006598243B1

(12) United States Patent
Thomas

(10) Patent No.: US 6,598,243 B1
(45) Date of Patent: Jul. 29, 2003

(54) WIND OPERATED ACTUATOR FOR SWIMMING POOLS

(75) Inventor: Christopher John Thomas, 2521 E. Bluefield Ave., Phoenix, AZ (US) 85001

(73) Assignee: Christopher John Thomas, Phoenix, AZ (US)

( * ) Notice: Subject to any disclaimer, the term of this patent is extended or adjusted under 35 U.S.C. 154(b) by 0 days.

(21) Appl. No.: 10/116,906

(22) Filed: Jul. 15, 2002

(51) Int. Cl.[7] ..... E04H 4/16
(52) U.S. Cl. ..... 4/496; 4/490; 137/78.5
(58) Field of Search ..... 4/490, 496; 137/78.5

(56) References Cited

U.S. PATENT DOCUMENTS

| | | | | |
|---|---|---|---|---|
| 2,067,413 A | | 1/1937 | Plaisted | 361/195 |
| 2,529,491 A | | 11/1950 | Gadzuk | 137/78.5 X |
| 2,780,937 A | | 2/1957 | Haynes | 73/170.15 |
| 3,117,586 A | | 1/1964 | Cleaver | 137/78.5 |
| 4,072,269 A | | 2/1978 | Berg | 137/78.2 X |
| 4,128,205 A | | 12/1978 | Coash | 239/1 |
| 4,579,105 A | * | 4/1986 | Marikovsky | 4/490 X |
| 4,697,737 A | | 10/1987 | Pearce | 239/67 |
| 5,021,939 A | | 6/1991 | Pulgiese | 364/143 |
| 5,340,025 A | | 8/1994 | Pearce | 137/78.1 X |
| 5,394,601 A | * | 3/1995 | Sutton et al. | 29/451 |
| 5,823,433 A | | 10/1998 | Harlow | 137/78.5 X |

* cited by examiner

*Primary Examiner*—Robert M. Fetsuga

(57) ABSTRACT

A wind sensitive operating system for swimming pools would enable swimming pools to activate cleaning systems during times of high winds. Currently swimming pools cannot sense high wind conditions and altar their running conditions accordingly. This invention would have a control box which could sense high winds and start up swimming pool cleaning systems at a predetermined wind velocity and a predetermined time length of high wind.

1 Claim, 1 Drawing Sheet

WIND OPERATED ACTUATOR FOR SWIMMING POOLS

CROSS-REFERENCE TO RELATED APPLICATIONS

Not applicable.

BACKGROUND

1. Field of Invention

This invention relates to swimming pool equipment, specifically to activating pool equipment by wind speed.

2. Description of Prior Art

Most swimming pool systems run on automatic timers, which turn pool cleaning systems on and off at the same times every day (for example: turns on 10:00 A.M. turns off 6:00 P.M.). This timer system acts independently of the wind. The reason a need for a wind-dependant system exists is that pools will keep themselves much cleaner by being able to clean themselves during high-debris (high wind) times. This will result in pools, which will last longer, use fewer chemicals and have cosmetic appeal to owners and users. Most Swimming pool surfaces last longer the,less dirt sits on them. Swimming pool water uses less chemicals the less the amount of debris in the water. Swimming pools are focal points of most residences and commercial properties that have one.

SUMMARY

The essence of my invention is that it will allow swimming cleaning systems to sense high wind conditions and act accordingly by turning on pool motors or valves which will more efficiently clean pools in high need times. After high winds die down my invention can shut down these cleaning systems after a short delay time. This system will not replace the standard time-clock set up but will augment it by providing the pool cleaning systems with knowledge of wind conditions.

OBJECTS AND ADVANTAGES

Accordingly, several objects and advantages of my invention are:

(a) to keep swimming pools cleaner than existing systems do;

(b) to provide greater longevity of swimming pool surfaces;

(c) to provide lower chemical demand than existing systems do;

Further objects and advantages are providing the ability to swimming pool valves to switch themselves to the most advantageous positions for operating under high or low wind situations.

DRAWING FIGURES

REFERENCE NUMERALS IN DRAWINGS

| | |
|---|---|
| 10 wind propeller | 12 control box |
| 14 in-line fuse | 16 connection |
| 18 connection | 20 connection |
| 22 wind sensor | 24 activating switch |
| 26 connection | |

DESCRIPTION—FIGS. 1 AND 2—PREFERRED EMBODIMENT

Figure 1:
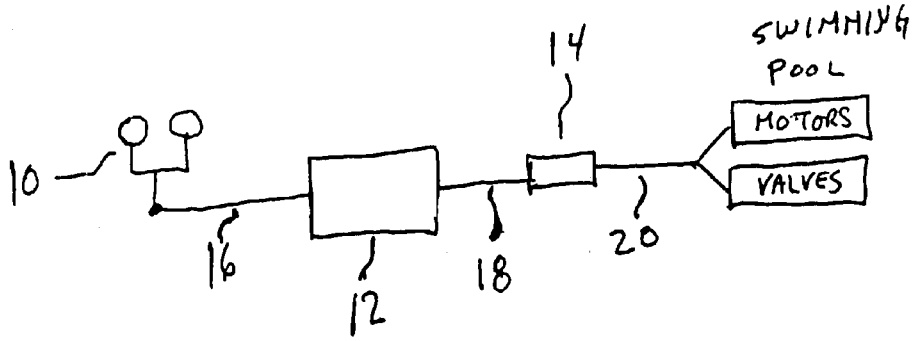
FIG. 1 shows an overall layout of my invention.
Figure 2:
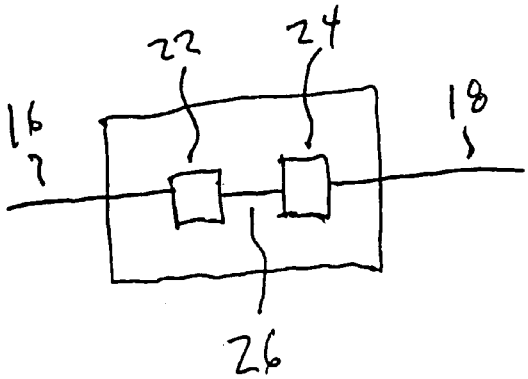
FIG. 2 shows a general layout of the control box for my invention.

FIG. 1 shows an overall layout of my invention. It consists of a wind propeller 10, a control box 12. An in-line fuse 14 and their connections 16, 18 and 20. FIG. 2 shows a general layout of the control box. It consists of a wind-speed sensor 22 and an activating switch 24.

OPERATION—FIGS. 1 AND 2

A wind propeller 10 sends information to a wind speed sensor 22 via a connection 16. At this point a sensor will sense either high wind speeds for a given period of time (for example 20 mph for 10 minutes) or low wind speeds for a given period of time (for example 5 mph for 10 minutes) and act accordingly by first turning on pool cleaning systems and then deactivating these systems. An activating switch 24 will act according to the input it receives via connection 26 and send appropriate info to pool cleaning systems via connection 18.

CONCLUSION, RAMIFICATIONS AND SCOPE

My invention will allow swimming pools to sense high wind conditions and enable them to activate pool cleaning systems at times of high wind. This invention would dramatically increase the cleanliness of pools on which it was attached. Also the invention would increase the lifetime of pool surfaces by substantially helping to keep debris off the surfaces.

I claim:

1. A wind operated actuator for swimming pools, comprising:

a. a wind-speed detection system for enabling swimming pool systems to sense high wind conditions, b. an activating system for enabling swimming pools to run accordingly for high or low wind conditions, c. means for transferring knowledge of high wind conditions to activation of swimming pool systems, whereby said actuator will be able to sense wind conditions and actuate swimming pool systems accordingly.

* * * * *